US007580663B2

(12) United States Patent
Kaiho

(10) Patent No.: US 7,580,663 B2
(45) **Date of Patent: *Aug. 25, 2009**

(54) IMAGE FORMING APPARATUS COMPRISING A MOVE MEMBER WHICH MOVES TO THE SURFACE OF THE PHOTOSENSITIVE DRUMS

(75) Inventor: Satoshi Kaiho, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/968,799

(22) Filed: Jan. 3, 2008

(65) Prior Publication Data

US 2008/0101812 A1 May 1, 2008

Related U.S. Application Data

(63) Continuation of application No. 11/223,042, filed on Sep. 12, 2005, now Pat. No. 7,333,759.

(51) Int. Cl.
*G03G 15/01* (2006.01)

(52) U.S. Cl. ..... 399/302; 399/299

(58) Field of Classification Search ..... 399/298, 399/299, 302
See application file for complete search history.

(56) References Cited

U.S. PATENT DOCUMENTS

| | | | | |
|---|---|---|---|---|
| 6,556,802 | B2 | 4/2003 | Sasamoto et al. | |
| 7,130,552 | B2 | 10/2006 | Nishida et al. | |
| 7,333,759 | B2 * | 2/2008 | Kaiho | 399/302 |
| 2007/0059054 | A1 | 3/2007 | Furukawa | |
| 2007/0196141 | A1 * | 8/2007 | Kitagawa et al. | 399/302 |

FOREIGN PATENT DOCUMENTS

JP 10-181927 A 7/1998

* cited by examiner

*Primary Examiner*—Susan S Lee
(74) *Attorney, Agent, or Firm*—Foley & Lardner LLP

(57) ABSTRACT

A transfer roller drive unit sets an all-separate mode after setting a full-color mode, sets a monochrome mode after setting the all-separate mode, and sets a full-color mode after setting the monochrome mode. Namely, a transfer belt 25 comes into contact with the photosensitive drum 24 first, and then the photosensitive drums 21, 22 and 23. This pattern is repeated. The transfer belt 25 does not come into contact with the photosensitive drums 21, 22, 23 and 24 at a time.

20 Claims, 14 Drawing Sheets

IMAGE FORMING APPARATUS COMPRISING A MOVE MEMBER WHICH MOVES TO THE SURFACE OF THE PHOTOSENSITIVE DRUMS

CROSS-REFERENCE TO RELATED APPLICATIONS

The present application is a Continuation of U.S. application Ser. No. 11/223,042, filed Sep. 12, 2005, the entire contents of which are incorporated herein by reference.

BACKGROUND OF THE INVENTION

An image forming apparatus having color copying capability is provided with photosensitive drums for the colors yellow, magenta, cyan and black. A laser beam is applied to the surfaces of these photosensitive drums, and electrostatic latent images are formed on the surfaces of the photosensitive drums. The electrostatic latent images are developed with developers for the colors yellow, magenta, cyan and black, and become visible images. The visible images are transferred to a transfer belt, which is moved in making contact with the surfaces of the photosensitive drums. The visible images of each color transferred to the transfer belt are transferred to a paper sheet. The transferred paper sheet is sent to a heating roller. The heating roller heats the paper sheet to fix the visible image transferred to the surface of the paper sheet. The transfer belt is pressed to the surfaces of the photosensitive drums by transfer rollers.

In such an image forming apparatus, the transfer belt is moved continuously even after the visible image is transferred to a paper sheet, until the unnecessary developer remaining on the transfer belt is eliminated by a cleaner. If the transfer belt is held contacting the photosensitive drums in this time, the surface of the photosensitive drum is worn and the drum life is reduced. To prevent this, after the visible images of each color on the transfer belt are transferred to a paper sheet, the transfer rollers pressing the transfer belt to the photosensitive drums are moved to the opposite side of the transfer belt. By this movement, the transfer belt is separated from the photosensitive drums. After the developer remaining on the transfer belt is eliminated with a cleaner, the transfer rollers are moved to the transfer belt and the transfer belt is brought into contact with the photosensitive drums.

However, vibration is generated when the transfer rollers are moved to the transfer belt and the transfer belt is brought into contact with the photosensitive drum. This vibration is transmitted to an exposing unit which exposes the photosensitive drum to a laser beam, and a scanning unit which optically reads an image of document, affecting the image forming operation. For example, jitter or color shift occurs in an image transferred to a paper sheet.

BRIEF SUMMARY OF THE INVENTION

It is an object of the present invention is to provide an image forming apparatus, which can decrease the vibration generated when a transfer belt comes into contact with photosensitive drums.

According to an aspect of the present invention, there is provided an image forming apparatus comprising:

photosensitive drums on which an image is formed;

a transfer belt which moves while contacting or separating from the surfaces of the photosensitive drums;

primary transfer rollers which are provided at the positions opposite to the photosensitive drums, moved to the transfer belt to make the transfer belt contact with the photosensitive drums, and transfers the images on the photosensitive drum to the transfer belt;

a secondary transfer roller which transfers the images transferred to the transfer belt to a paper sheet; and a transfer roller drive unit which has an all-contact mode to move all the primary transfer rollers to the transfer belt and make the transfer belt contact with all the photosensitive drums, and an all-separate mode to move all the primary transfer rolls to the opposite side of the transfer belt, and separate the transfer belt from all the photosensitive drums, and a partial contact mode to move only some primary transfer rollers to the transfer belt and make the transfer belt contact with the some primary transfer rollers, and sets the all-separate mode after the all-contact mode, sets the partial contact mode after the all-contact mode, and sets the all-contact mode after the partial contact mode.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the prevent invention will be explained hereinafter with reference to the accompanying drawings.

Figure 1:
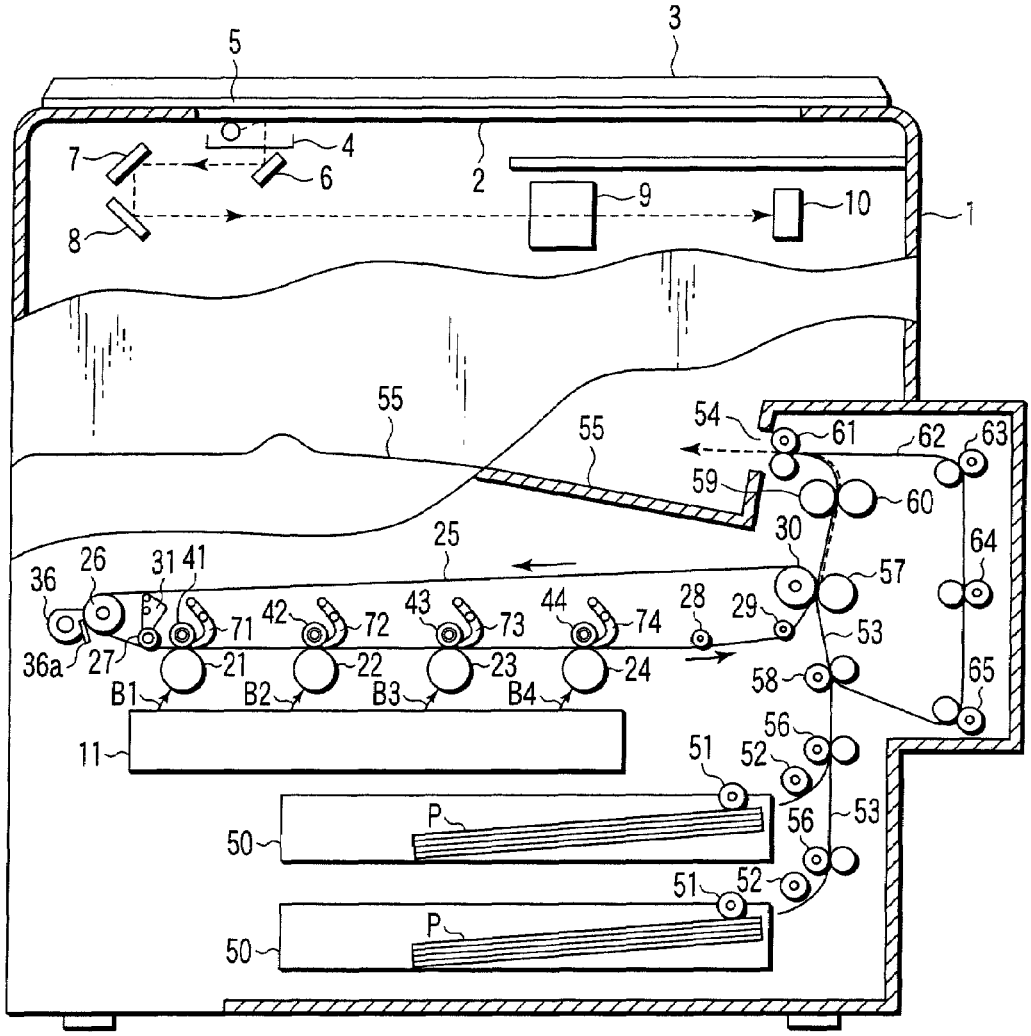
FIG. 1 is a view showing the whole structure of an embodiment of the present invention.

As shown in FIG. 1, a transparent document table (glass plate) 2 for setting a document is provided in the upper part of a main body 1. A cover 3 is provided openably on the document table 2. A carriage 4 is provided under the document table 2. An exposing lamp 5 is provided in the carriage 4. The carriage 4 can move forward and backward along the underside of the document table 2. When the carriage 4 moves forward and the exposing lamp 5 lights up, a document D set on the document table 2 is exposed. A reflected light image of the document D set on the document table is obtained by this exposing, and projected to a charge coupled device (CCD) 10 through reflecting mirrors 6, 7, 8 and a magnification-changing lens block 9. The CCD 10 outputs an image signal corresponding to the reflected light image of the document D.

The carriages 4, exposing lamp 5, reflecting mirrors 6, 7, 8, a magnification-changing 9, and CCD 10 constitute a scanning unit for reading optically the image of the document D set on the document table 2.

The image signal output from the CCD 10 is processed appropriately, and supplied to an exposing unit 11. The exposing unit 11 emits a laser beam B1 for a yellow image signal, a laser beam B2 for a magenta image signal, a laser beam B3 for a cyan image signal and a laser beam B4 for a black image signal to a photosensitive drum for yellow 21, a photosensitive drum for magenta 22, a photosensitive drum for cyan 23 and a photosensitive drum for black 24, respectively.

The photosensitive drums 21, 22, 23 and 24 are arranged substantially horizontally with fixed intervals. A transfer belt 25 is provided above the photosensitive drums 21, 22, 23 and 24. The transfer belt 25 is laid over a driving roller 26, guide rollers 27, 28, 29, and a follower roller 30. The transfer belt receives the power from the driving roller 26, and moves counter-clockwise. The guide roller 27 is provided movably up and down, and moved to the transfer belt 25 by the rotational of a (third) cam 31, and thereby shifting the transfer belt 25 to the photosensitive drums 21, 22, 23 and 24.

Primary transfer rollers 41, 42, 43 and 44 are provided movably up and down at the positions opposite to the photosensitive drums 21, 22, 23 and 24 through the transfer belt 25. The primary transfer rollers 41, 42, 43 and 44 are moved (down) to the transfer belt 25, make the transfer belt 25 contact with the photosensitive drums 21, 22, 23 and 24, and transfer visible images on the photosensitive drums 21, 22, 23 and 24 to the transfer belt 25.

Figure 2:
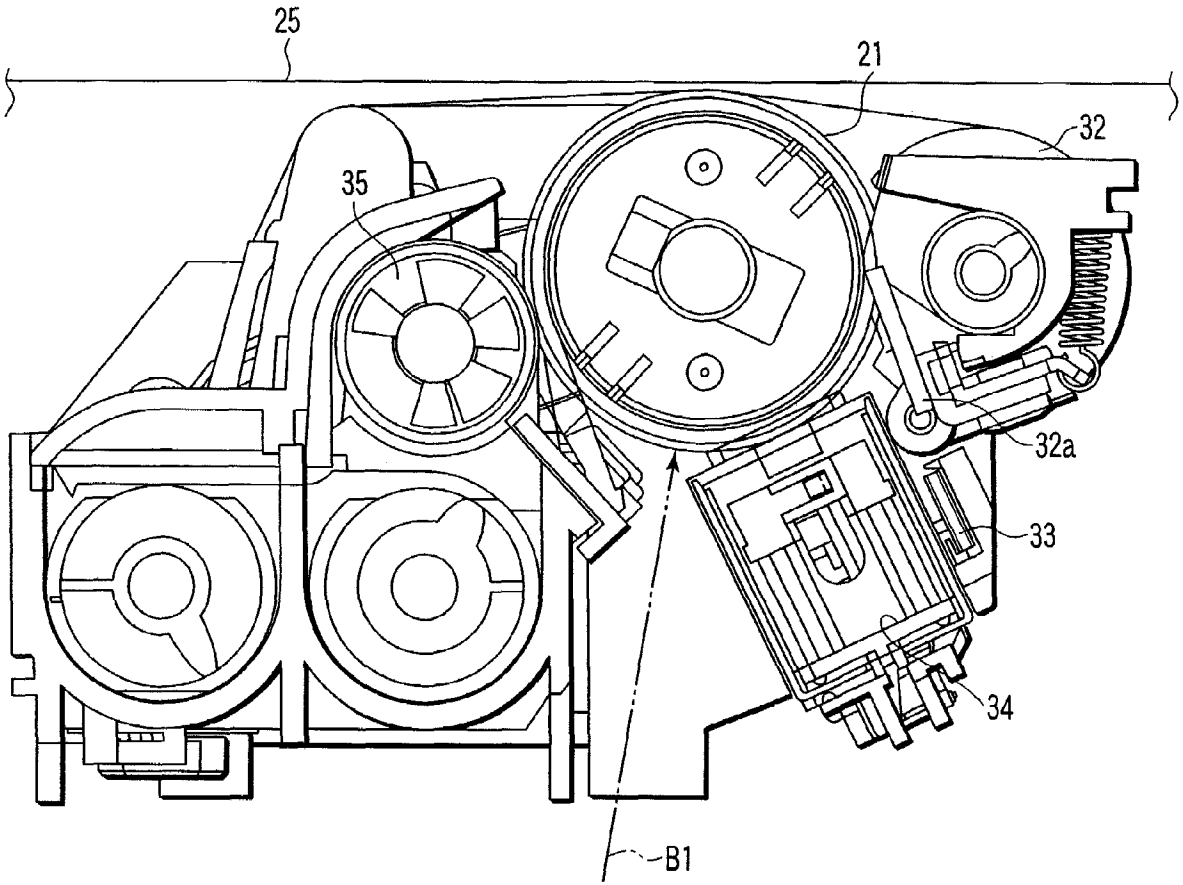
FIG. 2 is a view showing the structure of one photosensitive drum according to an embodiment of the invention, and surrounding parts.

FIG. 2 shows the configuration of the photosensitive drum 21 and surrounding parts. Namely, a cleaner 32, a discharge lamp 33, a charging unit 34, and a developing unit 35 are sequentially arranged around the photosensitive drum 21. The cleaner 32 has a cleaning blade 32*a* to contact the surface of the photosensitive drum 21, and scrapes off the developer remaining on the surface of the photosensitive drum 21 with the cleaning blade 32*a*. The discharge lamp 32 eliminates the electric charges remained on the surface of the photosensitive drum 21. The charging unit 34 electrostatically charges the surface of the photosensitive drum 21 by applying a high voltage to the photosensitive drum 21. A laser beam B1 emitted from the exposing unit 11 is applied to the surface of the charged photosensitive drum 21. A static latent image is formed on the surface of the photosensitive drum 21 by this application of a laser beam. The developing unit 35 supplies a developer (toner) for the color yellow to the surface of the photosensitive drum 21, thereby visualizing the static latent image on the surface of the photosensitive drum 21.

The configuration of the other photosensitive drums 22, 23, 24, and surrounding parts are the same, and explanation will be omitted.

Paper supply cassettes 50 are provided below the exposing unit 11. These cassettes 50 contain many paper sheets P of different sizes. Paper sheet P is taken out one by one from any one of these cassettes 50. A Pickup roller 51 is provided in each cassette 50 for taking out a paper sheet. The taken-out paper sheet P is separated from the cassette 50 by a separating roller 52 and supplied to a paper conveying path 53.

The paper conveying path 53 extends to a paper ejection port 54 located above through the follower roller 30. The paper ejection port 54 faces an ejected paper tray 55 continued on the circumference of the main body 1.

At the beginning end of the paper conveying path 53, a paper feed roller 56 is provided close to the paper separating roller 52. Further, a secondary transfer roller 57 is provided at the position opposite to the follower roller 30 in substantially the middle of the paper conveying path 53, through the transfer belt 25. A registration roller 58 is provided at the position of this side of the follower roller 30 and secondary transfer roller 57. The registration roller 58 feeds a paper sheet P to between the transfer belt 25 and secondary transfer roller 57. The secondary transfer roller 57 holds the paper sheet P fed from the registration roller 58 in a space to the transfer belt 25 on the follower roller 30, and transfers the visible image transferred to the transfer belt 25 to the paper sheet P.

At the position downstream from the secondary transfer roller 57 in the paper conveying path 53, a heating roller 59 for heating and fixing and a pressing roller 60 to contact the heating roller 59 are provided. A paper ejecting roller 61 is provided at the terminal end of the paper conveying path 53.

A paper conveying path 62 for reversing the front and back of paper sheet P is provided in the part from the terminal end of the paper conveying path 53 to the upstream side of the registration roller 58. The paper conveying path 62 is provided with paper feeding rollers 63, 64 and 65. When the paper sheet P reaches the terminal end of the paper conveying path 53 and returns to the paper conveying path 53 through the paper conveying path 62, the visible image on the transfer belt 25 is transferred also to the back of the paper sheet P.

A cleaner 36 is provided at the position opposite to the driving roller 26 through the transfer belt 25. The cleaner 36 has a cleaning blade 36*a* to contact the transfer belt 25, and scrapes off the developer remaining on the transfer belt with the cleaning blade 36*a*.

Figure 3:
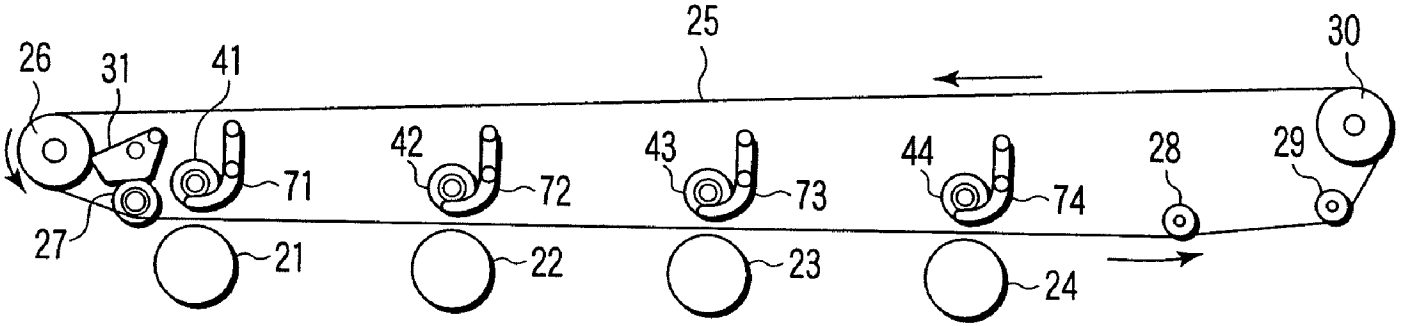
FIG. 3 is a view showing a transfer belt according to an embodiment of the invention, separating from all photosensitive drums.
Figure 4:
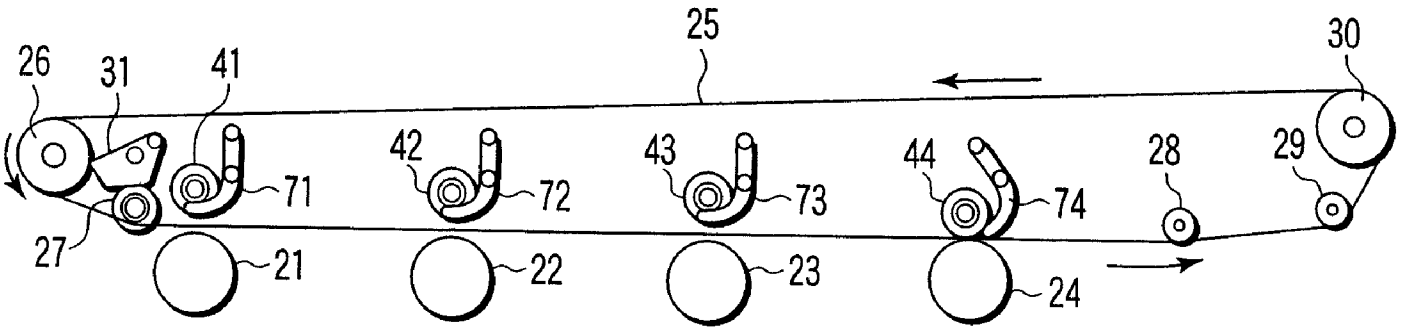
FIG. 4 is a view showing a transfer belt according to an embodiment of the invention, separating from three photosensitive drums and contacting one photosensitive drum.

Hooks 71, 72, 73 and 74 are provided in the vicinity of the primary transfer rollers 41, 42, 43 and 44. As shown in FIGS. 3 and 4, the hooks 71, 72, 73 and 74 move the primary transfer rollers 41, 42, 43 and 44 to the transfer belt 25 (upward) by engaging with and raising the shafts of the primary transfer rollers 41, 42, 43 and 44 while rotating. FIG. 3 shows the state that all hooks 71, 72, 73 and 74 rotate and move the primary transfer rollers 41, 42, 43 and 44 to the side opposite to the transfer belt 25 (upward), and the transfer belt 25 is separated from all photosensitive drums 21, 22, 23 and 24 (called an all-separate mode). FIG. 4 shows the state that only the hooks 71, 72 and 73 rotate and move the primary transfer rollers 41, 42 and 43 to the side opposite to the transfer belt 25 (upward), the primary transfer roller 44 remains in the transfer belt 25, and the transfer belt 25 contacts only the photosensitive drum 24 for the color black (called a monochrome mode or a partial contact mode). FIG. 1 shows the state that all the primary transfer rollers 42, 42, 43 and 44 move to the transfer belt 25 (downward), and the transfer belt 25 contacts all photosensitive drums 21, 22, 23 and 24 (called a full-color mode or an all-contact mode).

Figure 5:
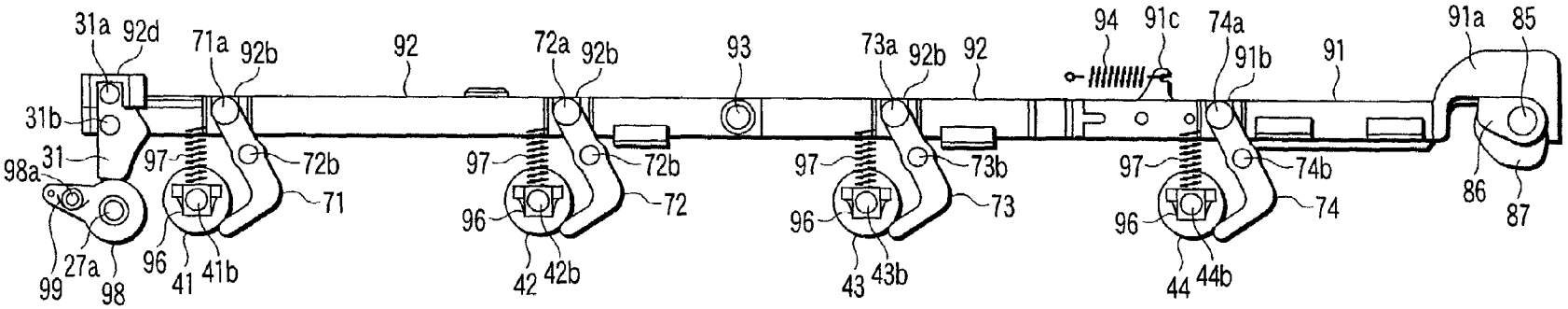
FIG. 5 shows the configuration of a transfer roller drive unit and primary transfer rollers according to an embodiment of the invention, viewed from the side.
Figure 6:
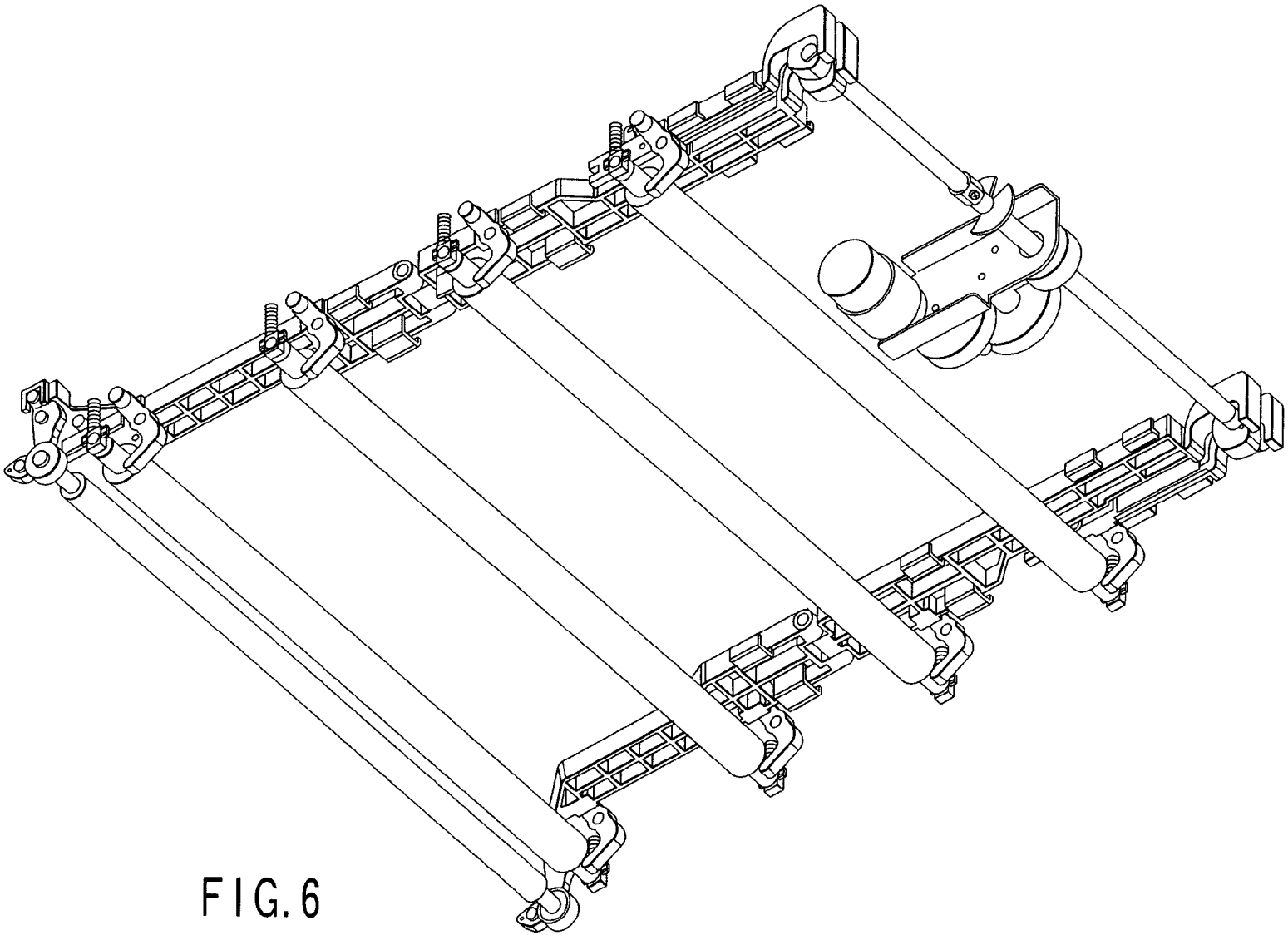
FIG. 6 shows the configuration of a transfer roller drive unit and primary transfer rollers according to an embodiment of the invention, viewed diagonally from the lower side.
Figure 7:
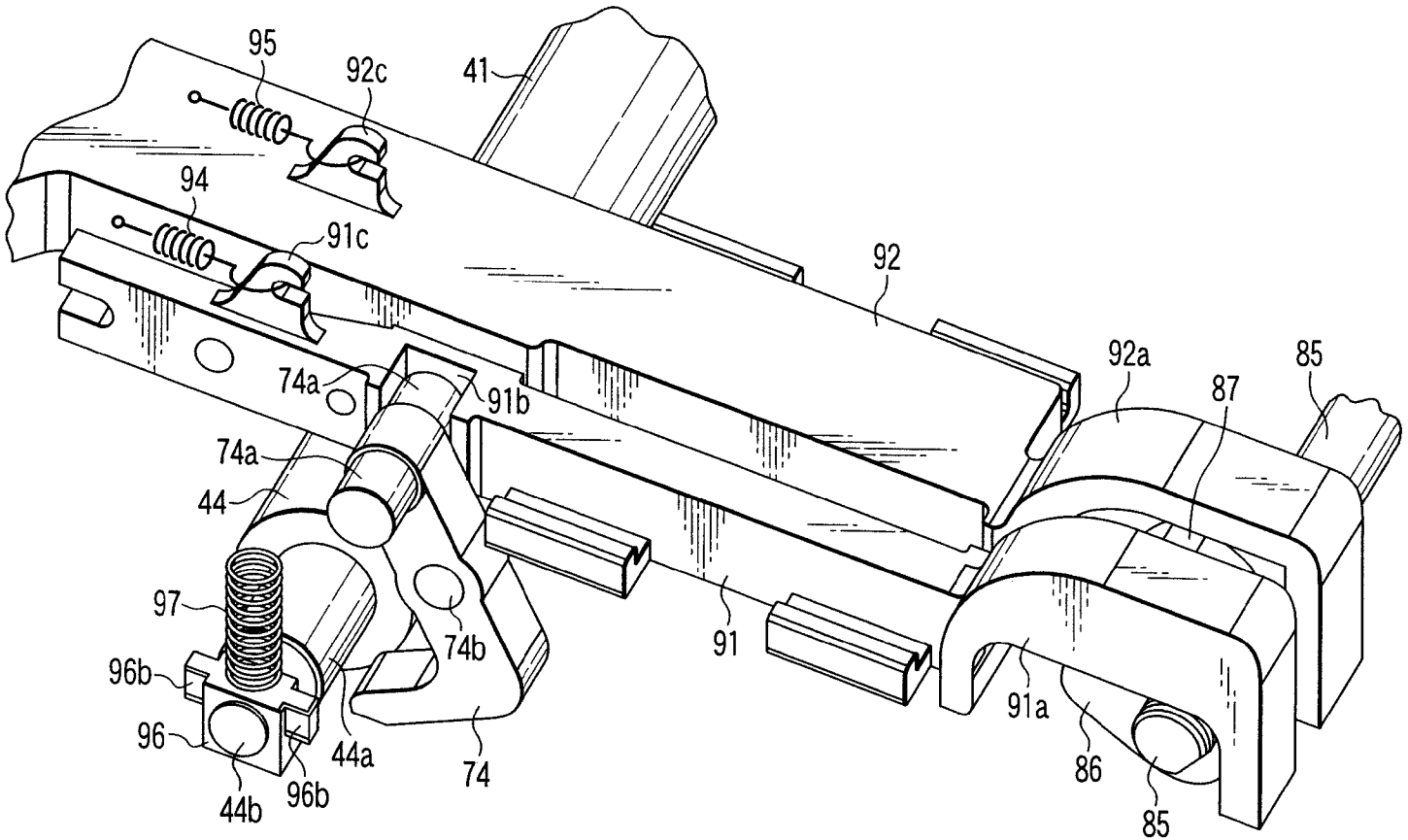
FIG. 7 shows the essential part of the transfer roller drive unit of FIG. 6, viewed diagonally from the upper side.

A transfer roller drive unit shown in FIGS. 5 and 6 is provided to drive the hooks 71, 72, 73 and 74. FIG. 5 shows the configuration of a transfer roller drive unit and primary transfer rollers 41, 42, 43 and 44 viewed from the side. FIG. 6 shows the configuration of a transfer roller drive unit and primary transfer rollers 41, 42, 43 and 44 viewed diagonally from the lower side. The transfer roller drive unit will be explained hereinafter.

A motor 81 is provided in a bracket 80. The power of the motor 81 is transmitted to a gear 84 through reduction gears 82 and 83. A shaft 85 is provided in the gear 84. The shaft 85 is provided parallel to the primary transfer rollers 41, 42, 43 and 44, and has substantially the same length as the axial direction of the primary transfer rollers 41, 42, 43 and 44.

A cam (first cam) 86 is provided at one end and the other end of the shaft 85. A cam (second cam) 87 is provided inside the cam 86 at one end and the other end of the shaft 85.

A lever (first lever) 91 to move forward and backward according to the rotation of the cam 86 is provided in the part from the cam 86 at one end of the shaft 85 to substantially the mid position between the primary transfer rollers 43 and 44. A cam housing 91*a* to contain the cam 86 is provided at one end of the lever 91. A groove 91*b* to fit rotatably with a link shaft 74*a* at the upper end of the hook 74 is formed on the side of the lever 91. A hook 91*c* for fixing a spring 94 is provided on the upper surface of the lever 91. The spring 94 gives the lever 91*a* deviating force toward the guide roller 27.

When the motor 81 is driven and the shaft 85 is rotated, the cam 86 is rotated together while pressing the internal circumference of the cam housing 91*a* to the shaft 85. The lever 91 is moved to the shaft 85 against the deviating force of the spring 94. When the lever 91 is moved to the shaft 85, the link shaft 74*a* fit in the groove 91*b* is also moved to the shaft 85. When the link shaft 74*a* is moved to the shaft 85, the hook 74 rotates about a pivot 74*b*, and the lower end of the hook 74 engages with and raises the shaft 44*a* of the primary transfer roller 44. Thus, the primary transfer roller 44 is moved to the opposite side (upward) of the transfer belt 25.

A shaft core 44*b* passes through the center of the shaft 44*a* of the primary transfer roller 44. The shaft core 44*b* is inserted into the roller holding piece 96. A spring (first spring) 97 is provided upright on the upper surface of the roller holding piece 96. The spring 97 gives the roller holding piece 96 a deviating force toward the transfer belt 25 (downward). The hook 74 raises the shaft 44*a* of the primary transfer roller 44 against the deviating force of the spring 97.

Figure 8:
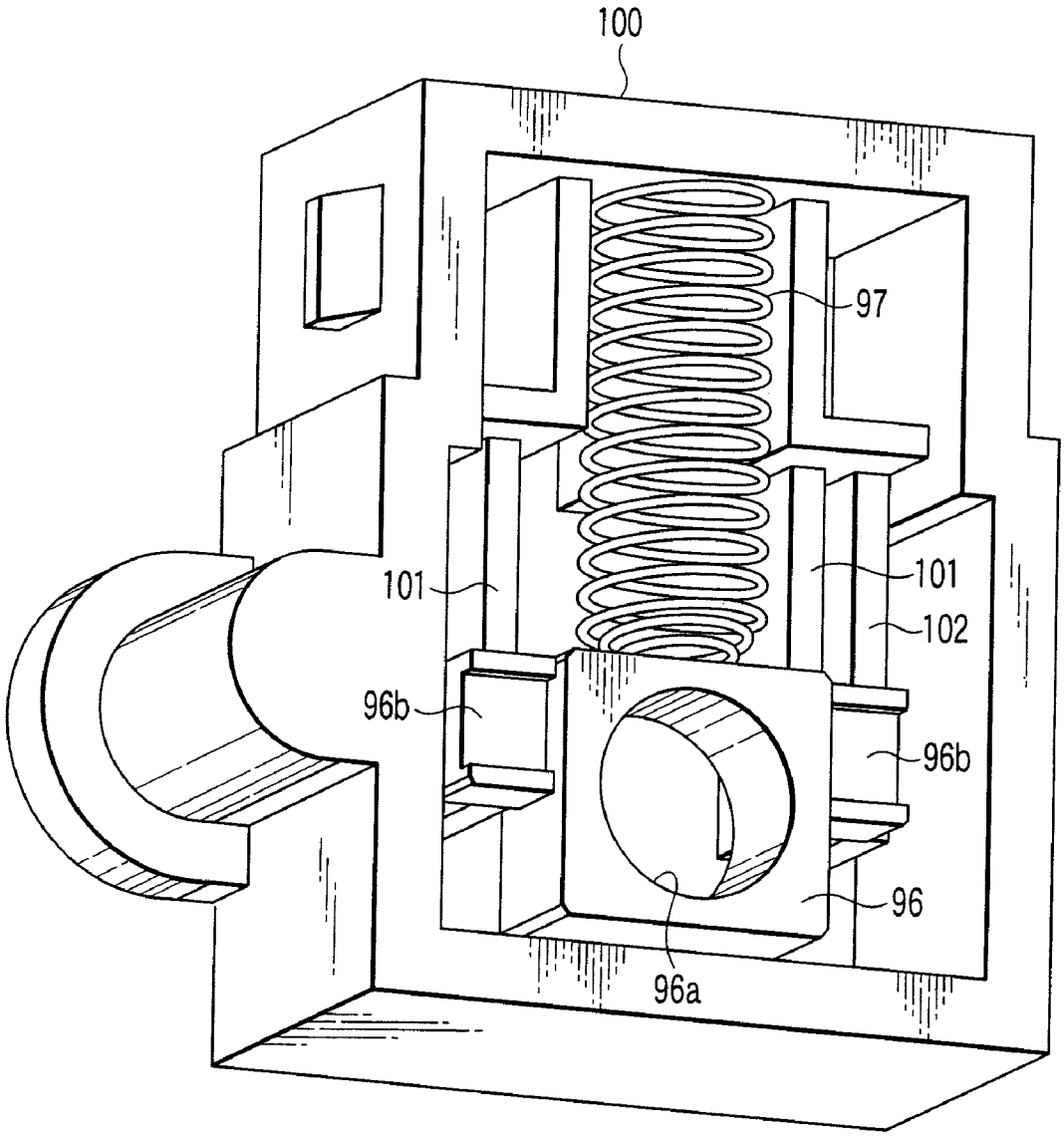
FIG. 8 shows the configuration of a roller holding frame in the transfer roller drive unit according to an embodiment of the invention, viewed diagonally from the lower side.

The roller holding piece 96 and spring 97 are contained in a roller holding frame 100 shown in FIG. 8. The roller holding piece 96 has an opening 96*a* to pass the shaft core 44*b*, and has flanges 96*b* for sliding up and down on both sides. These flanges 96*b* project to the side of the roller holding piece 96, and come in contact with slide guides 101 and 102 inside the roller holding frame 100.

When the cam 86 turns further and does not press the internal circumference of the cam housing 91*a*, the lever 91 is pulled to the guide roller 27 by the spring 94. When the lever 91 is pulled to the guide roller 27, the link shaft 74*a* fitted in the groove 91*b* is also moved to the guide roller 27. When the link shaft 74*a* is moved to the guide roller 27, the hook 74 is turned about the pivot 74 and returned to the original position, and the engagement between the lower end of the hook 74 and the shaft 44*a* of the primary transfer roller 44 is released. Then, the primary transfer roller 44 is moved to the transfer belt 25 (downward) by the deviating force of the spring 97.

The same configuration of lever 91, spring 94, hook 74, roller holding piece 96, spring 97 and roller holding frame 100 is provided also for the cam 86 at the other end of the shaft 85. Therefore, explanation will be omitted.

A lever (second lever) 92 to move forward and backward according to the rotation of the cam 87 is provided in the part from the cam 87 at one end of the shaft 85 to the vicinity of the guide roller 27. A cam housing 92*a* to contain the cam 87 is provided at one end of the lever 92. On the side of the lever 92, three grooves 92 are formed with intervals to contain rotatably the link shafts 71*a*, 72*a* and 73*a* at the upper end of the hooks 71, 72 and 73. On the upper surface of the lever 92, a hook 92*c* is provided to fix a spring 95. At the other end of the lever 92, a shaft housing 92*d* is provided to contain rotatably a link shaft 31*a* at the upper end of the cam 31. The spring 95 gives the lever 92 a deviating force toward the guide roller 27. The lever 92 is separated into two parts at the part corresponding to the position between the primary transfer roller 42 and primary transfer roller 43, and the separated portions are bendably connected by a link 93.

When the motor 81 is driven and the shaft 85 is rotated, the cam 87 rotates by pressing the internal circumference of the cam housing 92*a* to the shaft 85. The lever 92 is moved to the shaft 85 against the deviating force of the spring 95. When the lever 92 is moved to the shaft 85, the link shafts 71*a*, 72*a* and 73*a* fitted in the groove 92*b* are also moved to the shaft 85. When the link shafts 71*a*, 72*a* and 73*a* fit in the groove 92*b* are moved to the shaft 85, the hooks 71, 72 and 73 are rotated about the pivots 71*b*, 72*b* and 73*b*, the lower end portions of the hooks 71, 72 and 73 engage with and raise the shafts 41*a*, 42*a* and 43*a* of the primary transfer rollers 41, 42 and 43. Thus, the primary transfer rollers 41, 42 and 43 are moved to the opposite side (upward) of the transfer belt 25.

Shaft cores 41*b*, 42*b* and 43*b* pass through the shafts 41*a*, 42*a* and 43*a* of the primary transfer rollers 41, 42 and 43. The shaft cores 41*b*, 42*b* and 43*b* are inserted into the roller holding piece 96. The spring 97 is provided upright on the upper surface of the roller holding piece 96. The spring 97 gives the roller holding piece 96 a deviating force toward the transfer belt 25 (downward). The hooks 71, 72 and 73 raise the shafts 41*a*, 42*a* and 43*a* of the primary transfer rollers 41, 42 and 43 against the deviating force of the spring 97. The roller holding piece 96 and spring 97 are contained in the roller holding frame 100 shown in FIG. 8.

When the lever 92 is pulled to the shaft 85, the link shaft 31*a* contained in the shaft housing 92*d* is also moved to the shaft 85. When the link shaft 31*a* is moved to the shaft 85, the cam 31 rotates about the pivot insertion hole 31*b*. The cam 31 contacts the upper part of the roller holding member 98, and presses down the roller holding member 98 while not rotating, and releases the press-down while rotating. In the roller holding member 98, the shaft 27*a* of the guide roller 27 is rotatably inserted. Therefore, when the cam 31 rotates, the roller holding member 98 receives the deviating force of a spring (second spring) 99, rotates about the pivot 98*a*, and shifts to the opposite side (upward) of the transfer belt 25. When the roller holding member 98 shifts, the guide roller 27 is moved to the opposite side (upward) of the transfer belt 25.

When the cam 87 rotates further and does not press the internal circumference of the cam housing 92*a*, the lever 92 is pulled to the guide roller 27 by the spring 95. When the lever 92 is pulled to the guide roller 27, the link shaft 71*a*, 72*a* and 73*a* fitted in the groove 92*b* are also moved to the guide roller 27. When the link shaft 71*a*, 72*a* and 73*a* are moved to the guide roller 27, the hooks 71, 72 and 73 are rotated about the pivots 71*b*, 72*b* and 73*b* and returned to the original position, and the engagement between the lower ends of the hook 71, 72 and 73 and the shafts 41*a*, 42*a* and 43*a* of the primary transfer rollers 41, 42 and 43 is released. Then, the primary transfer rollers 41, 42 and 43 are moved to the transfer belt 25 (downward) by the deviating force of the spring 97.

When the lever 92 is pulled to the guide roller 27, the link shaft 31*a* contained in the link shaft housing 92*d* is also moved to the guide roller 27. When the link shaft 31*a* is moved to the guide roller 27, the cam 31 is rotated about the pivot insertion hole 31*b*, and returned to the original position. When the photosensitive drum 31 is returned to the original position, the upper part of the roller holding member 98 is pressed down against the deviating force of the spring 99. Thus, the roller holding member 98 rotates about the pivot 98*a*, and shifts to the transfer belt 25 (downward). When the roller holding member 98 shifts, the guide roller 27 moves to the transfer belt 25 (downward).

The same configuration of lever 92, link 93, spring 95, hooks 71, 72 and 73, roller holding piece 96, spring 97 and roller holding frame 100 is provided also for the cam 87 at the other end of the shaft 85. Therefore, explanation will be omitted.

Figure 9:
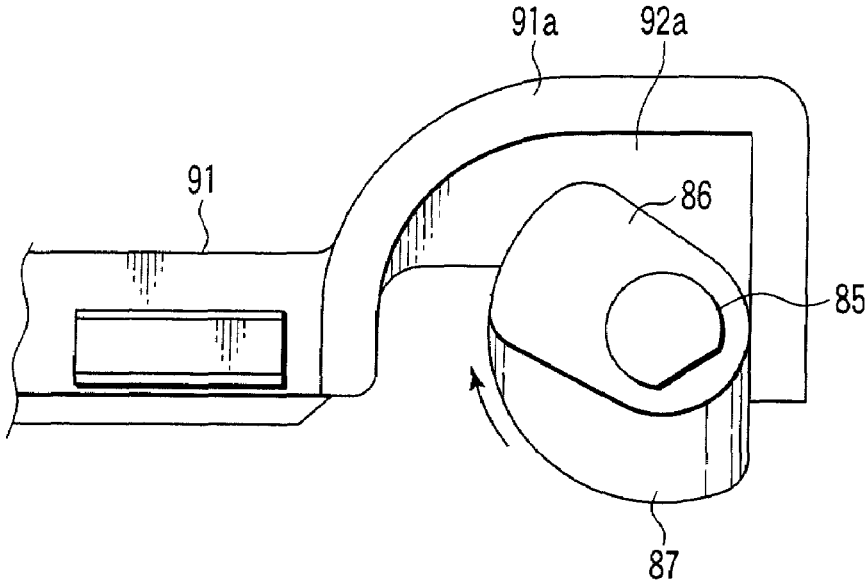
FIG. 9 shows the positions of cams when an all-separate mode according to an embodiment of the invention is set.
Figure 10:
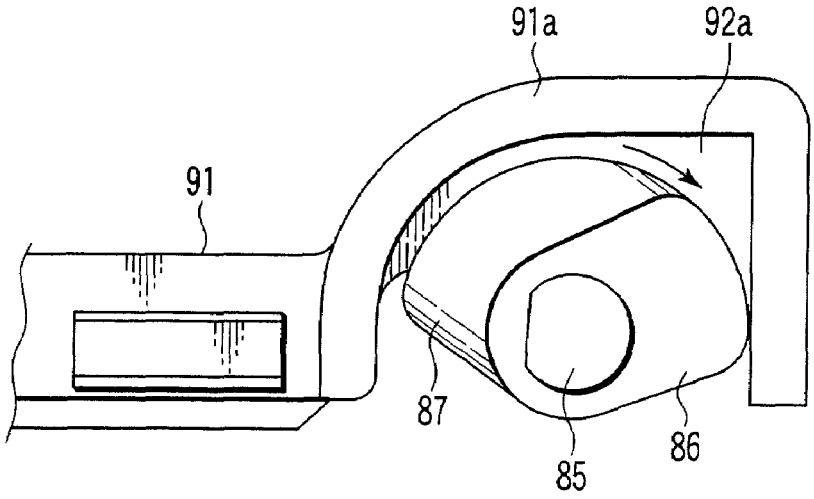
FIG. 10 shows the positions of cams when a partial contact mode of an embodiment of the invention is set.
Figure 11:
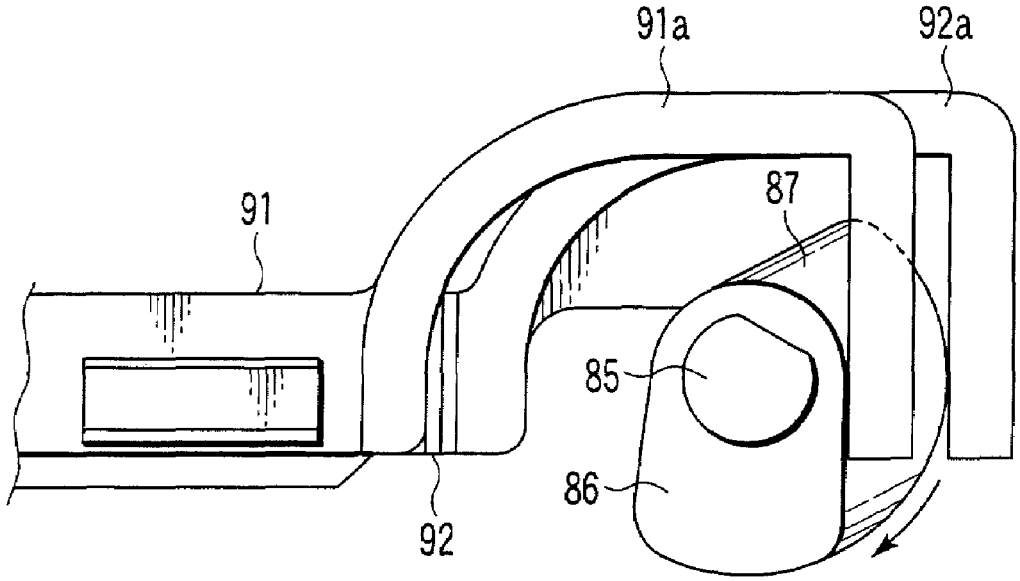
FIG. 11 shows the positions of cams when an all-contact mode according to an embodiment of the invention is set.

FIGS. 9, 10 and 11 show the states of the rotations of the cams 86 and 87.

When the cams 86 and 87 rotate to the positions shown in FIG. 9, the levers 91 and 92 are moved to the guide roller 27 by the deviating force of the springs 94 and 95. In this case, as shown in FIG. 1, a full-color mode (or an all-contact mode) is set, and all the primary transfer rollers 41, 42, 43, 44 and guide roller 27 are moved to the transfer belt 25, and the transfer belt 25 contacts all photosensitive drums 21, 22, 23 and 24. Namely, printing of all colors of yellow, magenta, cyan and black is possible.

When the cams 86 and 87 rotate further to the positions shown in FIG. 10, the levers 91 and 92 are moved to the shaft 85 against the deviating force of the springs 94 and 95. In this case, as shown in FIG. 3, an all-separate mode is set, and all the primary transfer rollers 41, 42, 43, 44 and guide roller 27 are moved to the opposite side of the transfer belt 25, and the transfer belt 25 is separated from all photosensitive drums 21, 22, 23 and 24. In the all-separate mode, the transfer belt 25 can be moved rotationally without contacting the photosensitive drums 21, 22, 23 and 24. Therefore, the transfer belt 25 can be cleaned with the cleaner 36 without affecting the life of the photosensitive drums 21, 22, 23 and 24.

When the cams 86 and 87 rotate further to the positions shown in FIG. 11, the lever 91 is moved to the guide roller 27 by the deviating force of the spring 94. The lever 92 is held in the state moved to the shaft 85. In this case, as shown in FIG. 4, a monochrome mode (or a partial contact mode) is set, and the primary transfer rollers 41, 42 and 43 are moved to the opposite side (upward) of the transfer belt 25, the primary transfer roller 44 remains on the transfer belt 25, and the transfer belt 25 contacts only the photosensitive drum 24 for the color black. Namely, monochrome printing of the color black using only the photosensitive drum 24 is possible.

Figure 12:
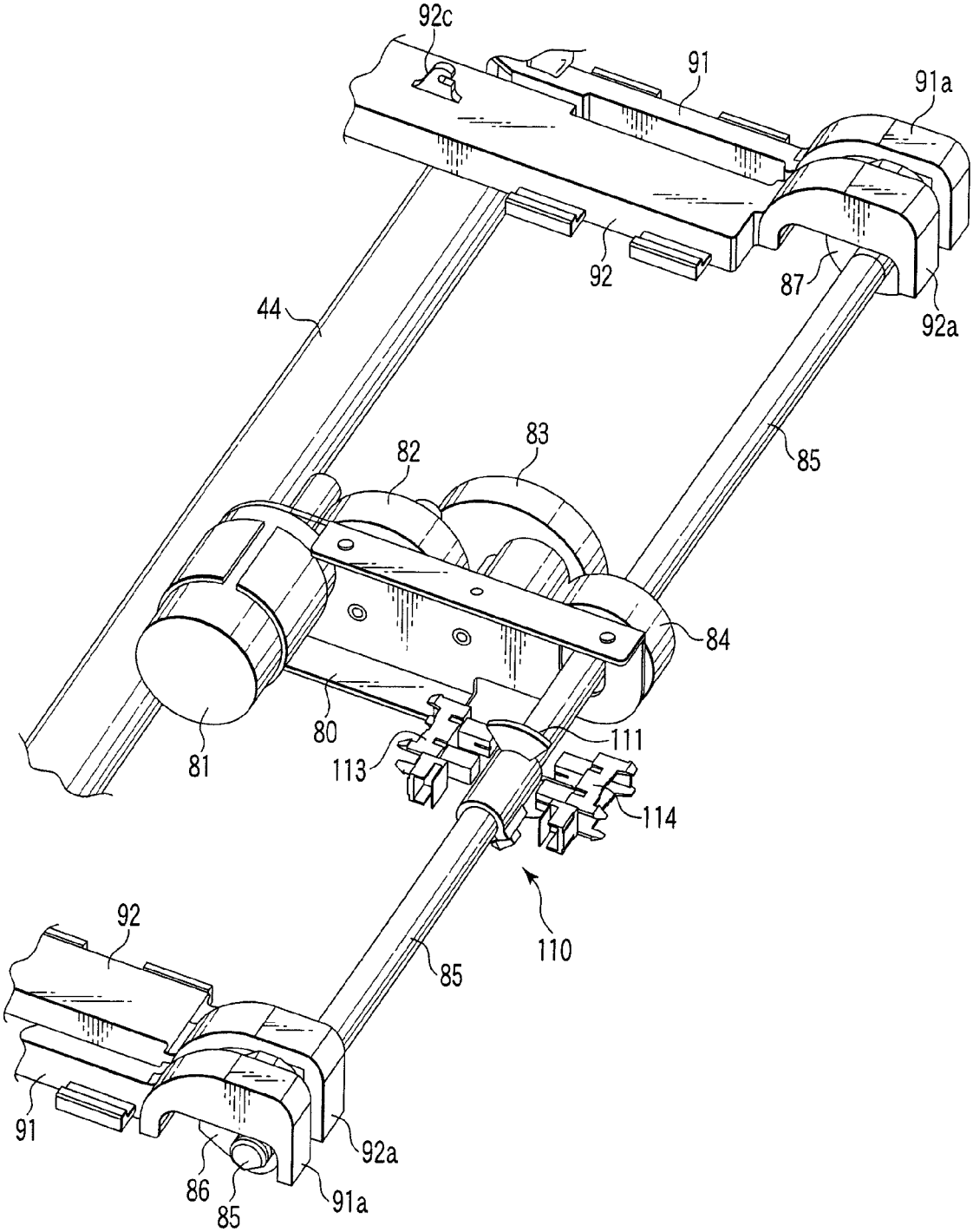
FIG. 12 shows the sensors of the transfer roller drive unit according to an embodiment of the invention and surrounding parts, viewed diagonally from the upper side.
Figure 13:
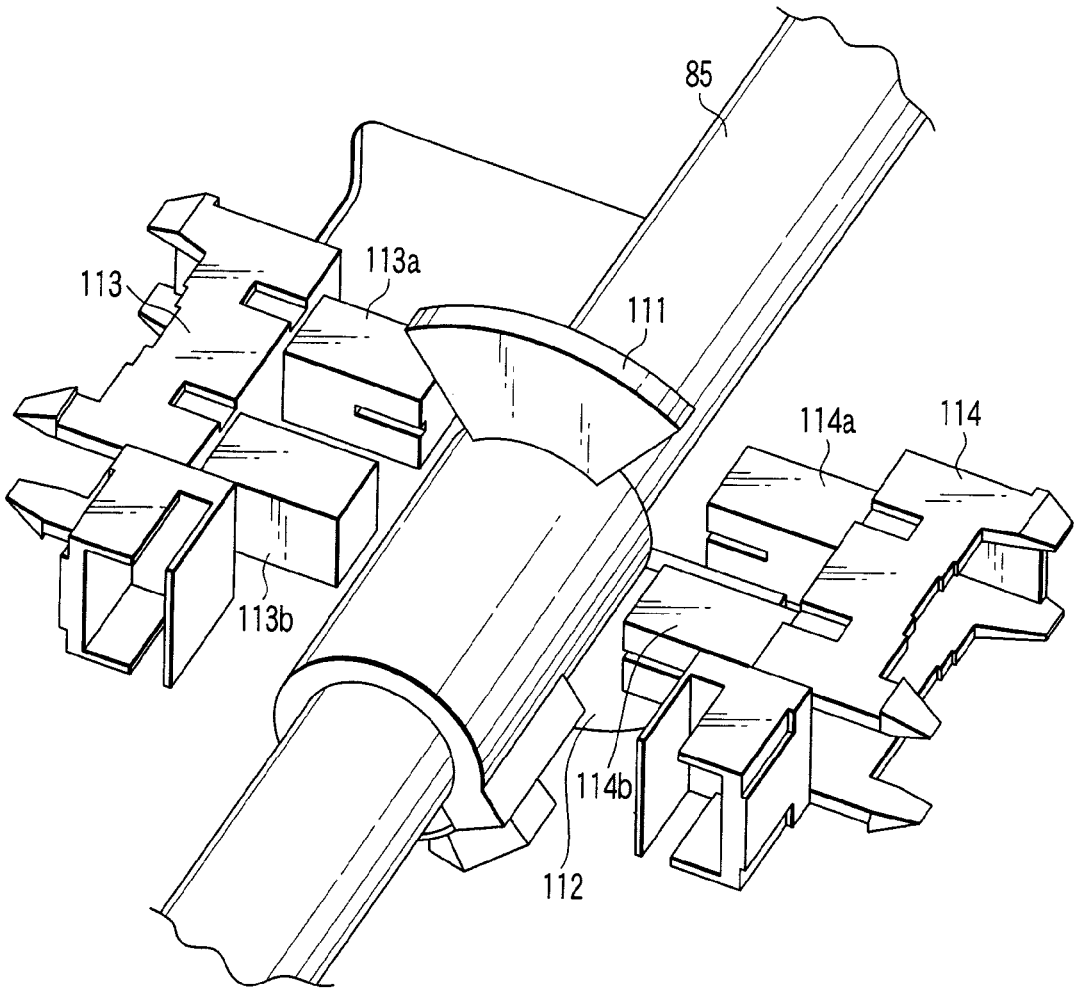
FIG. 13 is a magnified view of the essential part of FIG. 12.
Figure 14:
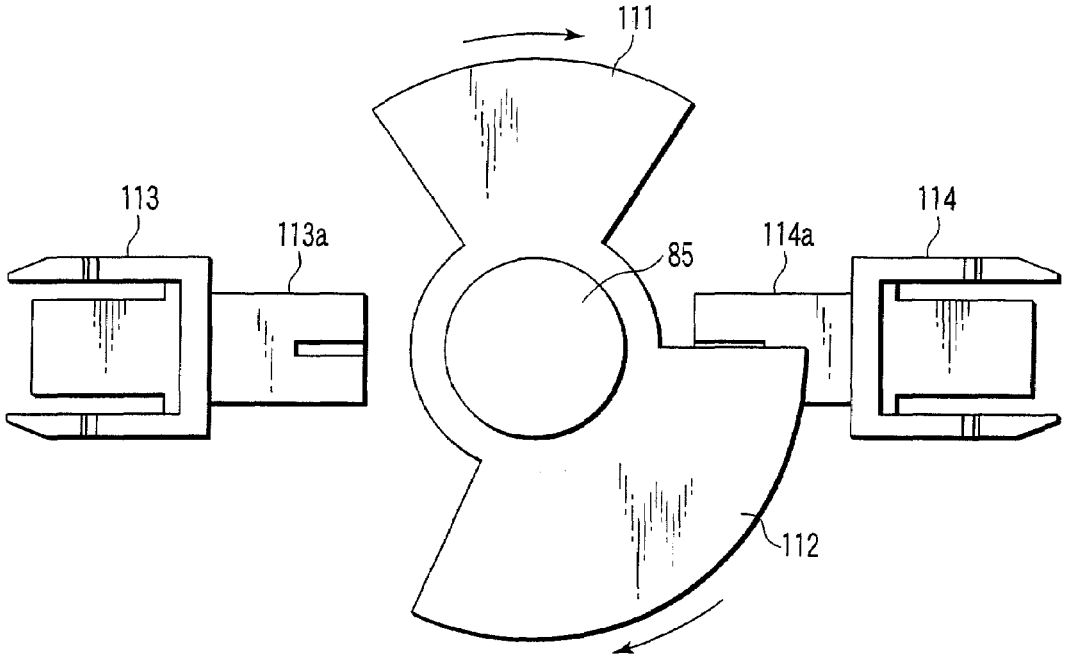
FIG. 14 shows a part of FIG. 13.

It is necessary to detect the rotated positions of the cams 86 and 87 to set the full-color mode, all-separate mode and monochrome mode. Therefore, as shown in FIGS. 12, 13 and 14, the position sensor 110 is provided to detect the rotated positions of the cams 86 and 87.

The position sensor 110 has two blades 111 and 112 provided substantially diagonal to the circumference of the shaft 85, and a first sensor 113 and a second sensor 114 for optically detecting the passage of the blades 111 and 112. The first sensor 113 and second sensor 114 are provided at the positions opposite to each other through the shaft 85.

The first sensor 113 has actuators 113*a* and 113*b* facing each other through the passing route of the blades 111 and 112, and optically detects the passage of the blades 111 and 112. The second sensor 114 has actuators 114*a* and 114*b* facing each other through the passing route of the blades 111 and 112, and optically detects the passage of the blades 111 and 112.

Figure 15:
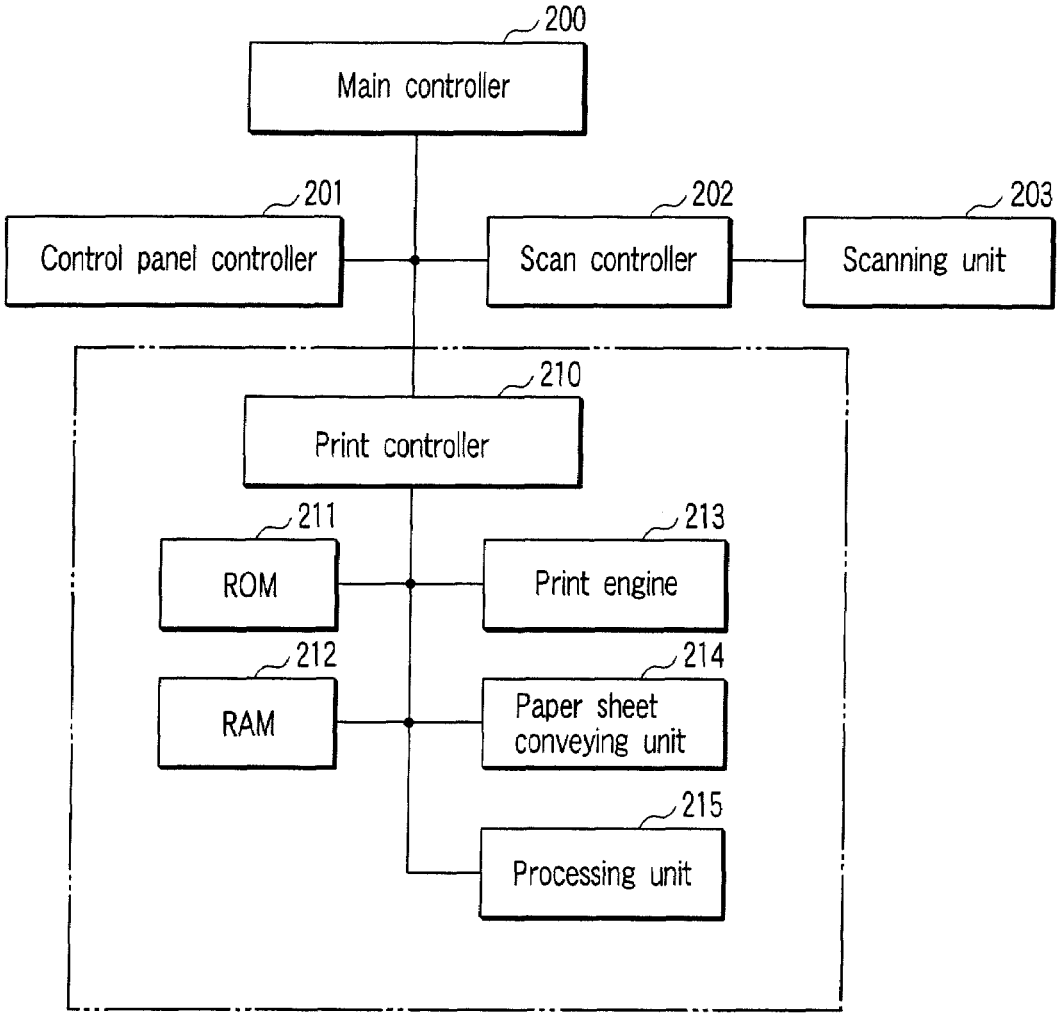
FIG. 15 is a block diagram of a control circuit according to an embodiment of the invention.

FIG. 15 shows the control circuit of the main body 1.

A main controller 200 is connected with a control panel controller 201, a scan controller 202 and a print controller 210. The main controller 200 integrally controls the control panel controller 201, scanner controller 202 and print controller 210.

A scanning unit 203 is connected to the scan controller 202. The scanning unit 203 consists of a carriage 4, an exposing lamp 5, reflecting mirrors 6, 7, 8, a magnification-changing lens block 9, and a CCD 10. The scanning unit optically reads an image of a document D set on the document table 2.

The print controller 210 is connected with a control program storing ROM 211, a data storing RAM 212, a print engine 213, a paper sheet conveying unit 214, and a processing unit 215. The print engine 213 consists of an exposing unit 11. The paper sheet conveying unit 214 consists of a paper sheet P conveying mechanism and a driving circuit. The processing unit 215 consists of photosensitive drums 21, 22, 23, 24, a transfer belt 25, a driving roller 26 and a transfer roller drive unit.

The print controller 210 has the following means (1) as a main function concerning the control of the transfer roller drive unit.

(1) A control means which selectively sets the full-color mode, all-separate mode and monochrome mode by controlling the motor 81 according to the rotated positions of the cams 86 and 87 by grasping the rotated positions of the cams 86 and 87 by comparing the changes in the output signal levels of the first sensor 113 and second sensor 114.

Figure 16:
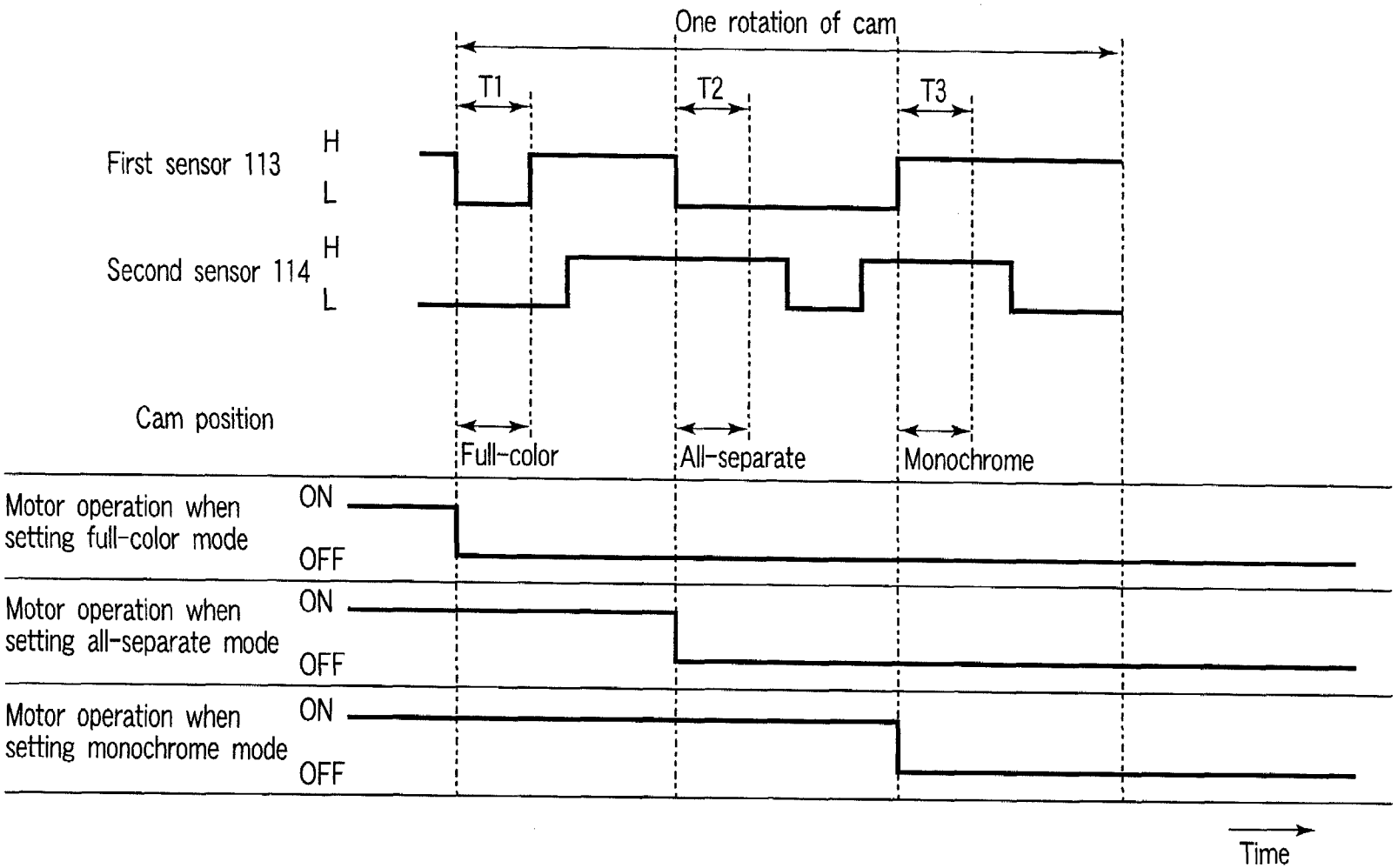
FIG. 16 is a timing chart for explaining the control of the transfer drive unit in one embodiment of the invention.

FIG. 16 is a timing chart showing the control of the transfer roller drive unit by the print controller 210.

Namely, by comparing the changes in the output signal levels of the first sensor 113 and second sensor 114, the rotated positions of the cams 86 and 87 or the full-color mode setting timing T1, all-separate mode setting timing T2 and monochrome mode setting timing T3 can be ascertained.

Therefore, the full-color mode can be set by operating the motor 81 and stopping the motor 81 at the full-color mode setting time T1. The all-separate mode can be set by operating the motor 81 and stopping the motor 81 at the all-separate mode setting timing T2. The monochrome mode can be set by operating the motor 81 and stopping the motor 81 at the monochrome mode setting timing T3.

The all-separate mode is set after setting the full-color mode, the monochrome mode is set after setting the all-separate mode, and the full-color mode is set after setting the monochrome mode. Namely, the transfer belt 25 comes into contact with the photosensitive drum 24 first, and then the photosensitive drums 21, 22 and 23. This pattern is repeated. The transfer belt 25 does not come into contact with the photosensitive drums 21, 22, 23 and 24 at a time. Therefore, the vibration generated when the transfer belt comes in contact with photosensitive drums can be decreased.

When the full-color mode is changed to the all-separate mode, the transfer belt 25 separates from all the photosensitive drums 21, 22, 23 and 24. Vibration is not generated in this time.

The motor 81 is operated only in one direction, and the motor drive control can be simplified.

As described above, the vibration generated when the transfer belt comes into contact with photosensitive drums can be decreased, and the operation of the exposing unit 11 and scanning unit 293 are stable. Therefore, good image forming without jitter or color shift is always possible.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

photosensitive drums on which an image is formed;

a move member which moves while contacting or separating from the surfaces of the photosensitive drums;

transfer members which are provided at the positions opposite to the photosensitive drums, moved to the move member to make the move member contact with the photosensitive drums, and transfers the images on the photosensitive drum to the move member; and a transfer member drive unit which has a first mode for all the transfer members contact with the move member, a second mode for some transfer members contact with the move member and some other transfer members separate from the move member, a third mode for all the transfer members separate from the move member, and makes the transfer members contact with the move member by sets the third mode, the second mode and the first mode in sequence.

2. The image forming apparatus according to claim 1, wherein the transfer member drive unit has springs which give the transfer member a deviating force toward the move member;

a motor;

a shaft to transmit the power of the motor;

a first cam and a second cam provided in the shaft;

at least one first lever which moves forward and backward according to the rotation of the first cam;

at least one second lever which moves forward and backward according to the rotation of the second cam;

at least one first hook which engages with at least one of the transfer members and moves the transfer member to the opposite side of the move member against the deviating force of the spring by interlocking with the forward movement of the first lever, and releases the engagement with the transfer member and moves the transfer member to the move member by the deviating force of the spring by interlocking with the backward movement of the first lever; and at least one second hook which engages with the transfer members not engaged with the first hook and moves the transfer members to the opposite side of the move member against the deviating force of the spring by interlocking with the forward movement of the second lever, and releases the engagement with the transfer members and moves the transfer members to the move member by the deviating force of the spring by interlocking with the backward movement of the second lever.

3. The image forming apparatus according to claim 2, wherein the transfer member drive unit has further a position sensor for detecting the rotated positions of the first cam and second cam.

4. The image forming apparatus according to claim 3, further comprising a controller which controls the operation of the motor according to the detection result of the position sensor, and sets selectively the first mode, second mode and third mode.

5. The image forming apparatus according to claim 4, wherein the position sensor has two blades provided on the circumference of the shaft, and a first sensor and a second sensor for optically detecting the passage of the blades; and the controller sets selectively the first mode, second mode and third contact mode by controlling the motor according to the rotated positions of the first and second cams ascertained by comparing the changes in the output signal levels of the first sensor and second sensor.

6. The image forming apparatus according to claim 1, further comprising at least one guide member which moves to the move member, and shifts the move member to the photosensitive drums.

7. The image forming apparatus according to claim 6, wherein the transfer member drive unit has first springs which give the transfer member a deviating force toward the move member;

a second spring which gives the guide member a deviating force toward the move member;

a motor;

a shaft to transmit the power of the motor;

a first cam and a second cam provided in the shaft;

at least one first lever which moves forward and backward according to the rotation of the first cam;

at least one second lever which moves forward and backward according to the rotation of the second cam;

at least one first hook which engages with at least one of the transfer members and moves the transfer member to the opposite side of the move member against the deviating force of the spring by interlocking with the forward movement of the first lever, and releases the engagement with the transfer member and moves the transfer member to the move member by the deviating force of the spring by interlocking with the backward movement of the first lever;

at least one second hook which engages with the transfer members not engaged with the first hook and moves the transfer members to the opposite side of the move member against the deviating force of the spring by interlocking with the forward movement of the second lever, and releases the engagement with the transfer members and moves the transfer members to the move member by the deviating force of the spring by interlocking with the backward movement of the second lever; and at least one third cam which moves the guide member to the opposite side of the move member by the deviating force of the second spring by interlocking with the forward movement of the second lever, and moves the guide member to the move member against the deviating force of the second spring by interlocking with the backward movement of the second lever.

8. The image forming apparatus according to claim 1, further comprising a cleaner for cleaning the move member after the transfer with the transfer member.

9. The image forming apparatus according to claim 1, further comprising a heating member for fixing an image transferred to a paper sheet by heating.

10. An image forming apparatus comprising:

photosensitive drums for yellow, magenta, cyan and black colors;

an exposing unit which exposes the photosensitive drums and forms latent images corresponding to the colors on the surfaces of the photosensitive drums;

developing units which develop the latent images formed on the surfaces of the photosensitive drums by developers for the colors;

a move member which moves while contacting or separating from the surfaces of the photosensitive drums;

transfer members which are provided at the positions opposite to the photosensitive drums through the move member, moved to the move member to make the move member contact with the photosensitive drums, and transfers the developed images on the photosensitive drums to the move member; and a transfer member drive unit which has a first mode for all the transfer members contact with the move member, a second mode for some transfer members contact with the move member and some other transfer members separate from the move member, a third mode for all the transfer members separate from the move member, and makes the transfer members contact with the move member by sets the third mode, the second mode and the first mode in sequence.

11. The image forming apparatus according to claim 10, wherein the transfer member drive unit has springs which give the transfer member a deviating force toward the move member;

a motor;

a shaft to transmit the power of the motor;

a first cam and a second cam provided in the shaft;

at least one first lever which moves forward and backward according to the rotation of the first cam;

at least one second lever which moves forward and backward according to the rotation of the second cam;

at least one first hook which engages with the transfer member corresponding to the photosensitive drum for the color black among the transfer members and moves the transfer member to the opposite side of the move member against the deviating force of the spring by interlocking with the forward movement of the first lever, and releases the engagement with the transfer member and moves the transfer member to the move member by the deviating force of the spring by interlocking with the backward movement of the first lever; and second hooks which engage with one of the transfer member not engaged with the first hook and moves the transfer members to the opposite side of the move member against the deviating force of the spring by interlocking with the forward movement of the second lever, and releases the engagement with the transfer members and moves the transfer members to the move member by the deviating force of the spring by interlocking with the backward movement of the second lever.

12. The image forming apparatus according to claim 11, wherein the transfer member drive unit has further a position sensor for detecting the rotated positions of the first cam and second cam.

13. The image forming apparatus according to claim 12, further comprising a controller which controls the operation of the motor according to the detection result of the position sensor, and sets selectively the first mode, second mode and third mode.

14. The image forming apparatus according to claim 13, wherein the position sensor has two blades provided on the circumference of the shaft, and a first sensor and a second sensor for optically detecting the passage of the blades; and the controller sets selectively the first mode, second mode and third mode by controlling the motor according to the rotated positions of the first and second cams ascertained by comparing the changes in the output signal levels of the first sensor and second sensor.

15. The image forming apparatus according to claim 10, further comprising at least one guide member which moves to the move member, and shifts the move member to the photosensitive drums.

16. The image forming apparatus according to claim 15, wherein the transfer member drive unit has first springs which give the transfer members a deviating force toward the move member;

a second spring which gives the guide member a deviating force toward the opposite side of the move member;

a motor;

a shaft to transmit the power of the motor;

a first cam and a second cam provided in the shaft;

at least one first lever which moves forward and backward according to the rotation of the first cam;

at least one second lever which moves forward and backward according to the rotation of the second cam;

at least one first hook which engages with the transfer member corresponding to the photosensitive drum for the color black among the transfer members and moves the transfer member to the opposite side of the move member against the deviating force of the spring by interlocking with the forward movement of the first lever, and releases the engagement with the transfer member and moves the transfer member to the move member by the deviating force of the spring by interlocking with the backward movement of the first lever;

second hooks which engage with one of the transfer members not engaged with the first hook and moves the transfer members to the opposite side of the move member against the deviating force of the spring by interlocking with the forward movement of the second lever, and releases the engagement with the transfer members and moves the transfer members to the move member by the deviating force of the spring by interlocking with the backward movement of the second lever; and at least one third cam which moves the guide member to the opposite side of the move member by the deviating force of the second member by interlocking with the forward movement of the second lever, and moves the guide member to the move member against the deviating force of the second spring by interlocking with the backward movement of the second lever.

17. The image forming apparatus according to claim 10, further comprising a cleaner for cleaning the move member after the transfer with the transfer member.

18. The image forming apparatus according to claim 10, further comprising a heating member for fixing an image transferred to a paper sheet by heating.

19. The image forming apparatus comprising:

a scanning unit for optically reading an image of document;

photosensitive drums;

an exposing unit which exposes the photosensitive drums according to an image read by the scanning unit, and forms an electrostatic latent image on the surfaces of the photosensitive drums;

a move member which moves while contacting or separating from the surfaces of the photosensitive drums;

transfer members which are provided at the positions opposite to the photosensitive drums through the move member, moved to the move member to make the move member contact with the photosensitive drums, and transfer the developed images on the photosensitive drums to the move member; and a transfer member drive unit which has a first mode for all the transfer members contact with the move member, a second mode for some transfer members contact with the move member and some other transfer members separate from the move member, a third mode for all the transfer members separate from the move member, and makes the transfer members contact with the move member by sets the third mode, the second mode and the first mode in sequence.

20. The image forming apparatus according to claim 19, wherein the photosensitive drums are a photosensitive drum for a yellow color, a photosensitive drum for a magenta color, a photosensitive drum for a cyan color, and a photosensitive drum for a black color.

* * * * *